United States Patent [19]

van de Gent

[11] 4,095,392

[45] Jun. 20, 1978

[54] DEVICE FOR STACKING AND RETAINING IN A STACK FLAT GOODS, PARTICULARLY PLASTIC BAGS

[75] Inventor: Edouard Louis van de Gent, Meise, Belgium

[73] Assignee: Printex, Brussels, Belgium

[21] Appl. No.: 811,320

[22] Filed: Jun. 29, 1977

[30] Foreign Application Priority Data

Jun. 29, 1976 Belgium ..... 843546

[51] Int. Cl.[2] ..... B65B 35/50

[52] U.S. Cl. ..... 53/159; 53/197; 93/93 HT; 214/8

[58] Field of Search ..... 53/159, 197; 93/92, 93/93 HT; 214/6 M, 8

[56] References Cited

U.S. PATENT DOCUMENTS

| | | | |
|---|---|---|---|
| 3,523,686 | 8/1970 | Cawley | 214/8 |
| 3,633,731 | 1/1972 | Jones | 214/8 X |
| 3,831,504 | 8/1974 | Daly et al. | 93/93 HT |

*Primary Examiner*—Othell M. Simpson

*Assistant Examiner*—John Sipos

*Attorney, Agent, or Firm*—Cushman, Darby & Cushman

[57] ABSTRACT

There is described a device which comprises fixed means to feed forks one by one to the stacking location along a path at right angle to the transfer means movement direction between the parallel members and adjacent that edge provided with said perforations of those bags retained by said members, said forks of U-shape being free relative to one another, with legs directed at right angle to the transfer means movement direction and the leg free ends being directed towards the means allowing to release the bags from the transfer means in such a way that the fork legs enter the bag perforations, and means for moving the fork brought to the stacking location and on which will be stacked the bags to form a stack, along a direction in parallel relationship with the legs thereof to let said fork lie in two positions, the one position in which the fork is stationary to allow stacking the bags during said stacking operation and the second position in which the forks is free and can leave by gravity the device with the bags stacked thereon.

10 Claims, 3 Drawing Figures

DEVICE FOR STACKING AND RETAINING IN A STACK FLAT GOODS, PARTICULARLY PLASTIC BAGS

This invention relates to a device for stacking and retaining in a stack flat goods, particularly perforated plastic bags, which comprises transfer means with retaining members in parallel relationship cooperating with two opposite edges on the bags, allowing to bring said bags from the manufacturing machine to the stacking location and means for releasing said bags from the transfer means in said location to form a bag stack.

There are known presently for obtaining bag stacks on forks used for the automatic packing of goods and particularly for the automatic packing of bread, devices in which the bags are stacked one by one on rods made fast to a conveying means and fed by pairs, due to a stepwise movement of the conveying means, to the bag stacking location. Such devices have various drawbacks and mainly that they require a very high accuracy in the positioning of the rods when the conveying means thereof stops and it is noticed on such devices a number of bag alinement deficiencies due to variations in position of the rods relative to the correct position at the stacking location, variations which add up to the variations in the position of the bags when they are released from the transfer means thereof and this in spite of the perforations provided in the bags having a diameter which is much larger than the rod diameter. Said known devices have moreover the drawback of requiring on the one hand, the removal by hand of the bag stacks from said rods to transfer same to the forks which allow the conveying thereof and on the other hand, the arrangement by hand on said forks of the means such as cardboard, resilient washers, etc., for retaining said bags on the forks.

The invention has for object to obviate said drawbacks and to provide a device with a simple structure allowing to stack the bags directly on the forks allowing the conveying thereof up to the automatic packing machines, to locate very accurately all of the forks used one by one to form the stacks and to locate automatically on said forks those means for retaining the bags stacked thereon. Said device has first the substantial advantage of reducing very substantially the stacking deficiencies due to the forks always lying in the same position when the bags are released from the transfer means thereof and it is only necessary to consider the position variations of the bags as they are released from said means, said variations being more easily compensated for due to the differential between the perforation diameter and the fork leg diameter than said added variations. The device according to the invention has also the advantage of substantially reducing the handling operations to be performed as it does allow to avoid a manual arrangement of the bag stacks on the forks as required in the known devices as well as the manual arrangement of those means retaining the bags on the forks.

For this purpose according to the invention, the device comprise fixed means to feed forks one by one to the stacking location along a path at right angle to the transfer means movement direction between the parallel members and adjacent that edge provided with said perforations of those bags retained by said members, said forks of U-shape being free relative to one another, with legs directed at right angle to the transfer means movement direction and the leg free ends being directed towards the means allowing to release the bags from the transfer means in such a way that the fork legs enter the bag perforations, and means for moving the fork brought to the stacking location and on which will be stacked the bags to form a stack, along a direction in parallel relationship with the legs thereof to let said fork lie in two positions, the one position in which the fork is stationary to allow stacking the bags during said stacking operation and the second position in which the fork is free and can leave by gravity the device with the bags stacked thereon.

In an advantageous embodiment of the invention, the device comprises means so arranged as to locate on the fork legs when said fork lies in said first position and after stacking the last bag bag in a stack, at least one element cooperating resiliently with the fork legs for retaining the bags on said fork.

In a particularly advantageous embodiment of the invention, the device comprises means for arranging on the fork legs, either when said fork is brought to the first position thereof or when the fork lies in said first position and before stacking the bags, at least one element cooperating resiliently with the fork legs for retaining the bags on the fork legs and preventing said bags folding back by sliding off the fork legs on the fork bottom when said fork is released.

Other details and features of the invention will stand out from the description given below by way of non limitative example and with reference to the accompanying drawings, in which.

In the various figures, the same reference numerals pertain to similar elements.

Figure 1:
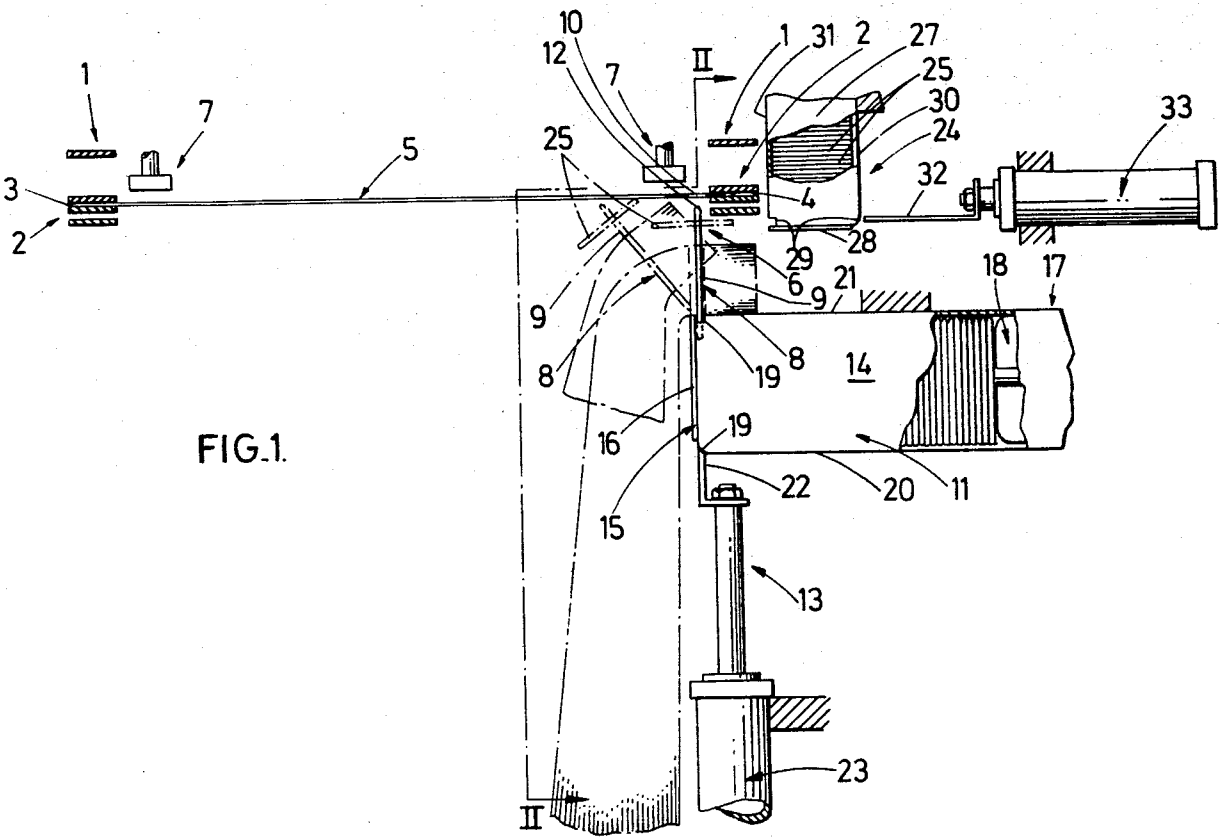
FIG. 1 is a diagrammatic elevation view with parts broken away of the device according to the invention.
Figure 2:
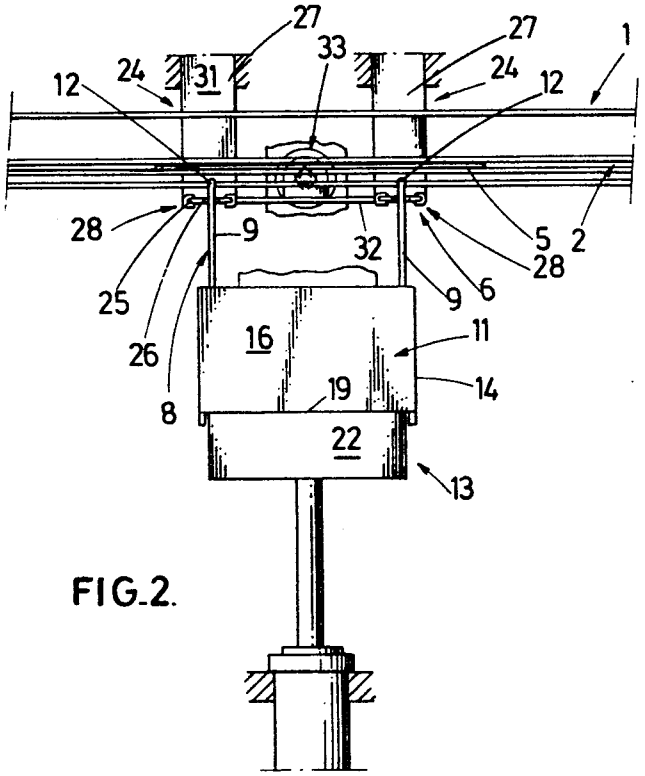
FIG. 2 is a view along line II—II in FIG. 1.

The device according to the invention and shown in the accompanying drawings comprises transfer means 1 which are well known notably from Belgian Pat. No. 563,370 with retaining members 2 in parallel relationship which cooperate with two opposite edges 3 and 4 of bags 5 allowing to feed said bags from the manufacturing machine therefor (not shown) to stacking location 6 and means 7 also known, allowing to release said bags from the transfer means 1 in said location 6 to form a bag stack on a U-shaped fork 8 the legs 9 of which enter perforations 10 provided in said bags. Said device comprises fixed means 11 to bring said forks 8 one by one to the stacking location 6 along a path at right angle to the movement direction of the transfer means 1 between the parallel members 2 and adjacent that bag edge 4 provided with the perforations 10. Said forks 8 are free relative to one another and the legs 9 thereof are directed at right angle to said movement direction with the free ends 12 facing the means 7, means 13 being provided to move the fork 8 brought to the stacking location 6 along a direction in parallel relationship with the legs 9 thereof to let it lie in two positions, a first position (shown in solid lines in FIG. 1) in which the fork 8 is secured to allow the stacking of the bags and during the complete duration of said stacking operation, and a second position (shown in dotted lines in FIG. 1) in which the fork 8 and the bag stack it does bear are free and can be released by gravity from said device. The means 11 for bringing the forks 8 one by one to location 6 are comprised of a magazine 14 of tubular shape and stationary, the lengthwise axis of which is at right angle to the movement direction of the transfer means 1 and in which the forks 8 are in alignement and guided. Said magazine 14 is provided at the end 15 thereof lying at the stacking location 6, with a closing plate 16 and it comprises at the end 17 thereof, means 18 exerting through the action either of a spring or a jack (not shown), a pressure on said forks 8 along the lengthwise axis of said magazine and directed towards the stacking location 6. The magazine 14 is provided at the end 15 thereof with two openings 19 in the walls 20 and 21 thereof, for letting a fork 8 through, and means 13 moving said fork and comprised of a push-rod 22 with a cross-section slightly smaller than the opening cross-section, to which is imparted an alternating motion along a direction in parallel relationship with the legs 9 of the forks, by means of a jack 23 the cylinder of which is fixed. The device as shown in FIGS. 1 and 2 comprises moreover fixed means 24 for arranging automatically on the fork legs 9 when said fork lies in the first position thereof and after stacking the last bag in a stack, elements 25 cooperating with said legs 9 to retain the bags thereon. Said means 24 are designed to arrange simultaneously on each one of the legs 9, a slit resilient washer 25 by feeding one by one said washers along a direction at right angle to the axis of said legs 9 and in parallel relationship with the slit 26 provided in said washers and exerting thereon a pressure towards the legs 9 to cause same to enter the washers through said slit 26 thereof. Said means 24 are comprised of two fixed tube-like magazines 27 inside which are lined-up and guided the washers with the slit thereof lying substantially in a plane passing through the axis of the legs 9 and the lengthwise axes of which lie in parallel relationship with said legs 9. Each one of said magazines 27 is closed at the end 28 thereof and comprises at the opposite end thereof means (not shown) such as a jack or spring, which exert a pressure on the washers along the magazine lengthwise axis and directed towards that location where the washers are laid in position, each one of said magazines 27 having at the end 28 thereof, two openings 29 provided in the walls 30 and 31 to let a washer 25 through, and a push-rod 32 common to both magazines 27 and with a cross-section slightly smaller than the opening cross-section to which is imparted an alternating motion along a direction at right angle to the axis of the legs 9 and in parallel relationship with the slit 26 of the washers, by means of a jack 33 the cylinder of which is fixed.

Figure 3:
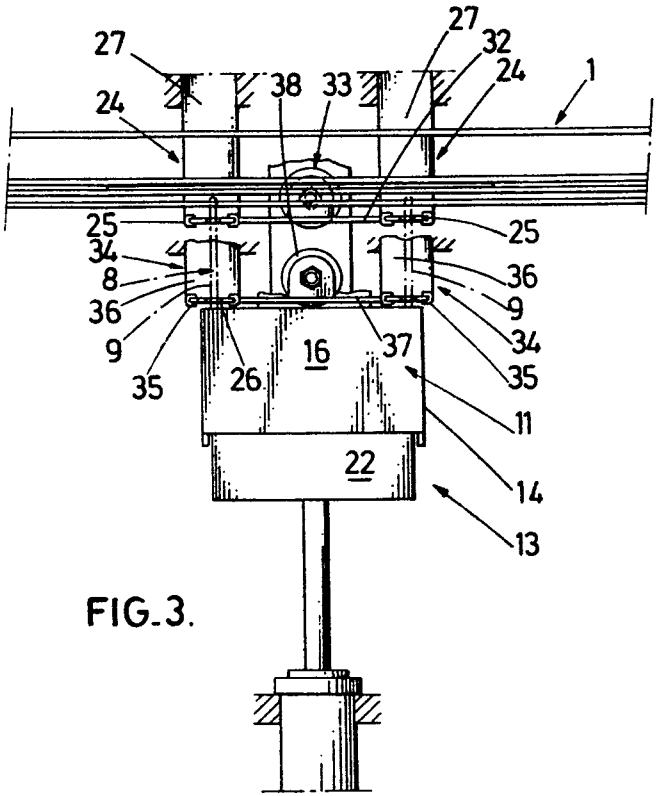
FIG. 3 is a view similar to FIG. 2 showing another embodiment of the device as shown in FIGS. 1 and 2.

According to the invention and as shown in FIG. 3, the device can be provided with fixed means 34 for arranging automatically on the fork legs 9, either when said fork is brought to said first position thereof, or when the fork lies in said position and before stacking the bags, elements 35 which cooperate resiliently with said legs 9 to retain the bags thereon and prevent said bags folding back by sliding off the legs on the fork bottom when said fork is released with the bag stack thereof. Said means 34 are identical with the above-described means 24 if use is made of slit washers 25, said washers being arranged on the legs 9 of a fork 8 by means of a push-rod 37 and a jack 38 when said fork lies in said first position. When use is made of unslit washers, said washers are to be fed to the setting station by magazines 36 similar to the magazines 27 before the fork 8 is released from magazine 14 to be brought to said first position thereof in such a way that when the fork is conveyed by push-rod 22 towards said position, fork legs 9 enter the washer holes, said washers being retained in the push-rod thereof during the introduction of the legs 9 and up to that moment where the fork lies in said first position thereof.

The elements 25 and 35 could be comprised instead of said washers, of strips provided with two perforations spaced by a distance equal to the spacing of fork legs 9, or with two perforations which are each joined to the one strip edge by a slit, each strip cooperating with both legs 9 to retain the bags thereon, the use of such strips allowing to lower the number of magazines.

According to the invention, the position of magazines 14, 27 and 36 is adjustable relative to the transfer means 1 and along a direction in parallel relationship with the movement direction thereof, to locate said magazines at the stacking station 6 which is determined according to the size of the bags to be stacked, as well as to change the position of the magazines 27 and 36 relative to the position of magazine 14 according to the spacing between legs 9 of forks 8, said spacing being determined by the spacing of the perforations 10 provided in the bags. The magazines 14, 27 and 36 are moreover removably arranged to allow on the one hand the use of different magazines according to the size of forks 8 and elements 25 and 35 and on the other hand, the fast loading of the device with forks 8 and elements 25 and 35.

It must be understood that the invention is in no way limited to the above embodiments and that many changes can be brought therein without departing from the scope of the invention as defined by the appended claims.

I claim:

1. Device for stacking and retaining in a stack flat goods, particularly perforated plastic bags, comprising transfer means with retaining members in parallel relationship cooperating with two opposite edges on the bags, allowing to bring said bags from the manufacturing machine to the stacking location and means for releasing said bags from the transfer means in said location to form a bag stack, which device comprises fixed means to feed forks one by one to the stacking location along a path at right angle to the transfer means movement direction between the parallel members and adjacent that edge provided with said perforations of those bags retained by said members, said forks of U-shape being free relative to one another, with legs directed at right angle to the transfer means movement direction and the leg free ends being directed towards the means allowing to release the bags from the transfer means in such a way that the fork legs enter the bag perforations, and means for moving the fork brought to the stacking location and on which will be stacked the bags to form a stack, along a direction in parallel relationship with the legs thereof to let said fork lie in two positions, the one position in which the fork is stationary to allow stacking the bags during said stacking operation and the second position in which the fork is free and can leave by gravity the device with the bags stacked thereon.

2. Device as defined in claim 1, which further comprises means so arranged as to locate on the fork legs when said fork lies in said first position and after stacking the last bag bag in a stack, at least one element cooperating resiliently with the fork legs for retaining the bags on said fork.

3. Device as defined in claim 1, which further comprises means for arranging on the fork legs, either when said fork is brought to the first position thereof or when the fork lies in said first position and before stacking the bags, at least one element cooperating resiliently with the fork legs for retaining the bags on the fork legs and preventing said bags folding back by sliding off the fork legs on the fork bottom when said fork is released.

4. Device as defined in claim 1, in which said means for bringing the forks one by one to the stacking station are comprised of a fixed tube-like magazine the lengthwise axis of which lies at right angle to said transfer means movement direction and inside which said forks are lined-up and guided, said magazine being closed at that end thereof located at the stacking station and comprising at the other end thereof means for exerting a pressure on the forks along the magazine lengthwise axis and directed towards the stacking station, said magazine having at the end thereof lying at the stacking location, two openings provided in those two opposite walls corresponding to the fork leg ends and designed to let through a fork and said means for moving said fork to both said positions, said latter means being comprised of a push-rod the cross-section of which is slightly smaller than the cross-section of said openings, and control means to move said push-rod with an alternating motion along a direction in parallel relationship with said fork legs.

5. Device as defined in claim 2, which further comprises means to arrange simultaneously on both fork legs to retain the bags thereon, a slit resilient washer, said means being so arranged as to move said washers one by one along a direction at right angle to the leg axis and to exert on said washers a pressure directed towards said legs to cause same to enter the washers through the slit provided therein.

6. Device as defined in claim 5, in which the means for laying the washers on the fork legs are comprised of four fixed tube-like magazines, two magazines for the washers to be laid on the fork before stacking the bags and two magazines for the washers to be laid after stacking the bags, said washers being lined-up and guided inside said magazines in such a way that the slit thereof be located in a plane passing through the leg axis and with the lengthwise axes thereof in parallel relationship with the fork legs, each magazine being closed at that end thereof located at the station where the washers are laid down and comprising at the other end thereof means exerting a pressure on the washers along the lengthwise axis of the magazine and directed towards the washer laying-down station, each magazine having at the end thereof located at the washer laying-down station, two openings provided in those two facing walls cross-wise to the washer slits to let through a washer and a push-rod with a cross-section slightly smaller than the opening cross-section, said push-rod being provided on each magazine to transfer the washers from the magazine to the fork legs and being alternated along a direction at right angle to the axis of the fork legs and in parallel relationship with the slit provided in the washers. move said 7. Device as defined in claim 3, which further comprises means to lay down simultaneously on both fork legs to retain the bags thereon, a resilient washer, said means being so arranged as to movesaid washers one by one along a direction at right angle to the fork axis in such a way that the washer hole axis be substantially in parallel relationship with the leg axis to bring the washers in such a position that both said axes are substantially coincident to cause the fork legs to enter the washer holes when the fork is brought to the first position thereof.

8. Device as defined in claim 7, in which the means for laying the washers down on the fork legs are comprised of two fixed tube-like magazines, each magazine being provided with a push-rod feeding the washers one by one to the laying-down station and so arranged as to retain the washer during the introduction of the fork leg through the washer hole.

9. Device as defined in claim 8, in which the magazine position is adjustable relative to the transfer means and along a direction in parallel relationship with the movement direction thereof to locate said magazines at the stacking location as determined according to the size of the bags to be stacked and to vary the position of those magazines containing said elements cooperating resiliently with the fork legs, relative to the position of that magazine containing the forks according to the spacing between the fork legs which is determined by the bag perforation spacing.

10. Device as defined in claim 8, in which said magazines are removably fastened to allow on the one hand the use of different magazines according to the size of the forks and the elements cooperating resiliently with the fork legs, and on the other hand the fast loading of said device.

* * * * *